US008387422B2

(12) United States Patent
Hettinger et al.

(10) Patent No.: US 8,387,422 B2
(45) Date of Patent: Mar. 5, 2013

(54) PULSATOR WASH SYSTEM

(75) Inventors: Stephen E. Hettinger, Louisville, KY (US); James Quentin Pollett, Louisville, KY (US)

(73) Assignee: General Electric Company, Schenectady, NY (US)

( * ) Notice: Subject to any disclaimer, the term of this patent is extended or adjusted under 35 U.S.C. 154(b) by 1284 days.

(21) Appl. No.: 12/130,481

(22) Filed: May 30, 2008

(65) Prior Publication Data

US 2009/0293554 A1 Dec. 3, 2009

(51) Int. Cl.
*D06F 17/10* (2006.01)

(52) U.S. Cl. ..... 68/134

(58) Field of Classification Search ..... 68/133, 68/134

See application file for complete search history.

(56) References Cited

U.S. PATENT DOCUMENTS

| | | | | |
|---|---|---|---|---|
| 1,615,952 | A * | 2/1927 | Nelson | 68/92 |
| 1,635,402 | A * | 7/1927 | Getz | 68/133 |
| 1,665,959 | A * | 4/1928 | Graham et al. | 68/54 |
| 1,704,932 | A * | 3/1929 | Altorfer | 68/133 |
| 1,747,750 | A * | 2/1930 | Beatty | 68/133 |
| 1,789,939 | A * | 1/1931 | Geldhof | 68/133 |
| 1,810,047 | A * | 6/1931 | Hersh | 68/134 |
| 1,897,414 | A * | 2/1933 | Baldner | 68/12.19 |
| 2,203,664 | A * | 6/1940 | Benson | 68/132 |
| 2,312,992 | A * | 3/1943 | Scheele | 68/134 |
| 2,430,211 | A * | 11/1947 | Cheney | 68/131 |
| 2,930,215 | A * | 3/1960 | Smith | 68/23.7 |
| 5,473,916 | A * | 12/1995 | Ye | 68/134 |
| 5,727,403 | A * | 3/1998 | Na | 68/133 |
| 5,839,300 | A * | 11/1998 | Yoon et al. | 68/134 |
| 5,931,029 | A * | 8/1999 | Kim | 68/134 |
| 6,212,722 | B1 * | 4/2001 | Pinkowski et al. | 8/158 |
| 6,978,554 | B2 | 12/2005 | Stinnett et al. | |
| 7,254,969 | B2 | 8/2007 | Hawkins et al. | |
| 2007/0101772 | A1 | 5/2007 | Duncan et al. | |
| 2007/0186595 | A1 * | 8/2007 | Iimori et al. | 68/17 R |

FOREIGN PATENT DOCUMENTS

| | | |
|---|---|---|
| JP | 11-276755 | * 10/1999 |
| JP | 2000-296286 | * 10/2000 |
| KR | 2001000993 | * 1/2001 |

* cited by examiner

*Primary Examiner* — Frankie L Stinson
(74) *Attorney, Agent, or Firm* — Fay Sharpe LLP

(57) ABSTRACT

A pulsator wash system includes a cabinet, a wash tub supported within the cabinet, a wash basket supported within the wash tub, and a drive system for rotating the wash basket. A pulsator is disposed adjacent a bottom of the wash basket and drivingly connected to the drive system. The pulsator includes a base portion, a central hub extending upward from the base portion, and a plurality of radially extending vanes extending upward from the base portion. Each of the plurality of radially extending vanes extends radially from about a peripheral radial edge of the base portion to a location spaced apart from the central hub.

22 Claims, 5 Drawing Sheets

PULSATOR WASH SYSTEM

This application is related to the U.S. patent application entitled "Fabric Softener Dispenser For Pulsator Wash System" 12/130,565, filed concurrently herewith, commonly assigned to General Electric Company, and expressly incorporated herein by reference.

BACKGROUND

The present disclosure generally relates to washing machines, and more particularly relates to a pulsator wash system employing a pulsator. In one embodiment, a pulsator for a washing machine includes a base portion, a central hub extending upward from the base portion, and a plurality of radially extending vanes extending upward from the base portion. The pulsator wash system and its pulsator will be described with particular reference to this embodiment, but it is to be appreciated that it is also amendable to other like applications.

Conventional vertical axis washing machines are known to include a center agitator disposed within a vertical axis wash basket, which is rotatably supported within a tub. Typically, the agitator extends upwardly from the bottom wall of the basket and has a height that is substantially equal to the height of the wash basket. A desirable clothes movement pattern in these types of washing machines is a rollover action wherein a clothes load, or individual items thereof, are moved down along the agitator barrel, then radially outward, and finally upward along an outer peripheral wall of the basket.

Also known is a second type of vertical axis washing machine wherein a pulsator or disk-like impeller is provided adjacent or along the bottom wall of the wash basket, the basket being rotatably supported within the tub of the washing machine. It is known to operate the pulsator of these types of washing machines in a manner which produces the rollover pattern discussed above, but also in a manner wherein a wash load, or individual items thereof, are directed upward along a vertical axis of the wash basket, then radially outward, and finally downward along an outer peripheral wall of the basket.

A continuing need in washing machines is improvements which allow laundry articles to be washed using less water and/or energy. Further, there is always a need for such improved washing machines that do not require a corresponding substantial product cost increase. Improved washing machines, particularly of the pulsator type, that use substantially less water and/or energy are increasingly desirable in view of anticipated, more stringent energy and water regulations. Moreover, there is always a need for lower energy and/or water wash systems on lower end washer models.

SUMMARY

According to one aspect, a pulsator wash system is provided. More particularly, in accordance with this aspect, the pulsator wash system includes a cabinet, a wash tub supported within the cabinet, a wash basket supported within the wash tub, and a drive system for rotating the wash basket. A pulsator is disposed adjacent a bottom of the wash basket and drivingly connected to the drive system. The pulsator includes a base portion, a central hub extending upward from the base portion, and a plurality of radially extending vanes extending upward from the base portion. Each of the plurality of radially extending vanes extends radially from about a peripheral radial edge of the base portion to a location that is radially spaced apart from the central hub.

According to another aspect, a pulsator is provided for a washing machine. More particularly, in accordance with this aspect, the pulsator includes a base portion and a central hub extending upward from the base portion. A plurality of radially extending vanes extend upward from the base portion. Each of the plurality of radially extending vanes extends radially from a peripheral radial edge of the base portion to a location that is radially spaced apart from the central hub.

According to yet another aspect, a pulsator is provided for a washing machine. More particularly, in accordance with this aspect, the pulsator includes a base portion disposed adjacent a bottom of a rotatably supported wash basket of the washing machine. A central hub extends upward from the base portion. A plurality of radially extending vanes extend upward from the base portion. Each of the plurality of radially extending vanes slopes upwardly from a peripheral radial edge of the base portion to an apex portion and then slopes downwardly to a location radially spaced apart from the central hub.

DETAILED DESCRIPTION

Figure 1:
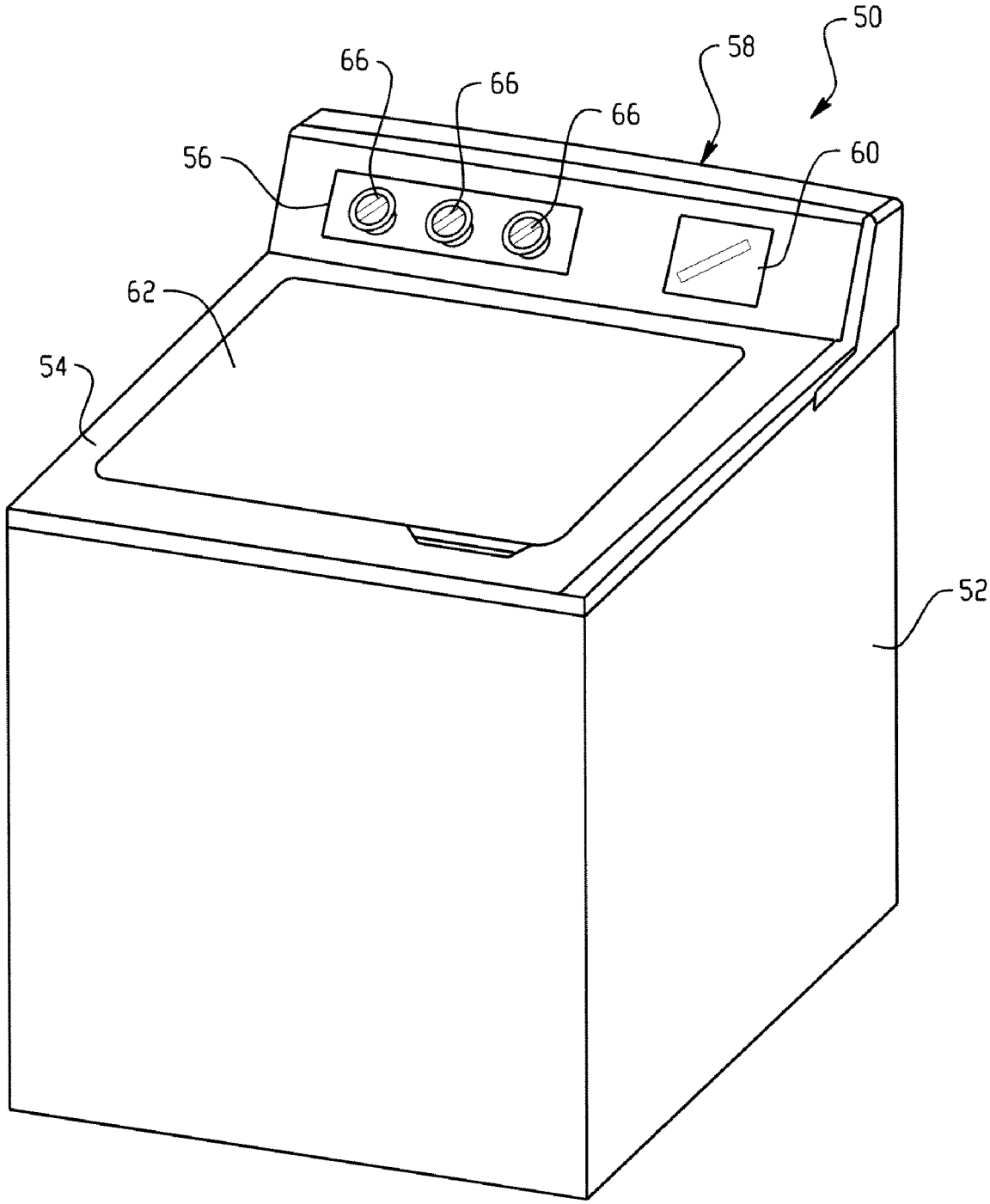
FIG. 1 is a perspective view of a washing machine.

Referring now to the drawings wherein showings are for purposes of illustrating one or more exemplary embodiments, FIG. 1 shows a pulsator wash system or machine 50 including a cabinet 52 and a cover 54. A backsplash 58 extends from the cover 54, and a control panel 56 including a plurality of input selectors 66 is coupled to the backsplash 58. As is known and understood by those skilled in the art, the control panel 56 and the input selectors 66 can collectively form a user interface input for operator selection of machine cycles and features. A display 60 can indicate the selected features, a countdown timer, and/or other items of interest to machine users. A lid 62 is mounted to the cover 54 and is pivotable about a hinge (not shown) between an open position facilitating access to a wash tub 64 (FIG. 2) located within the cabinet 52, and a closed position (as shown) forming an enclosure over the wash tub 64.

Figure 2:
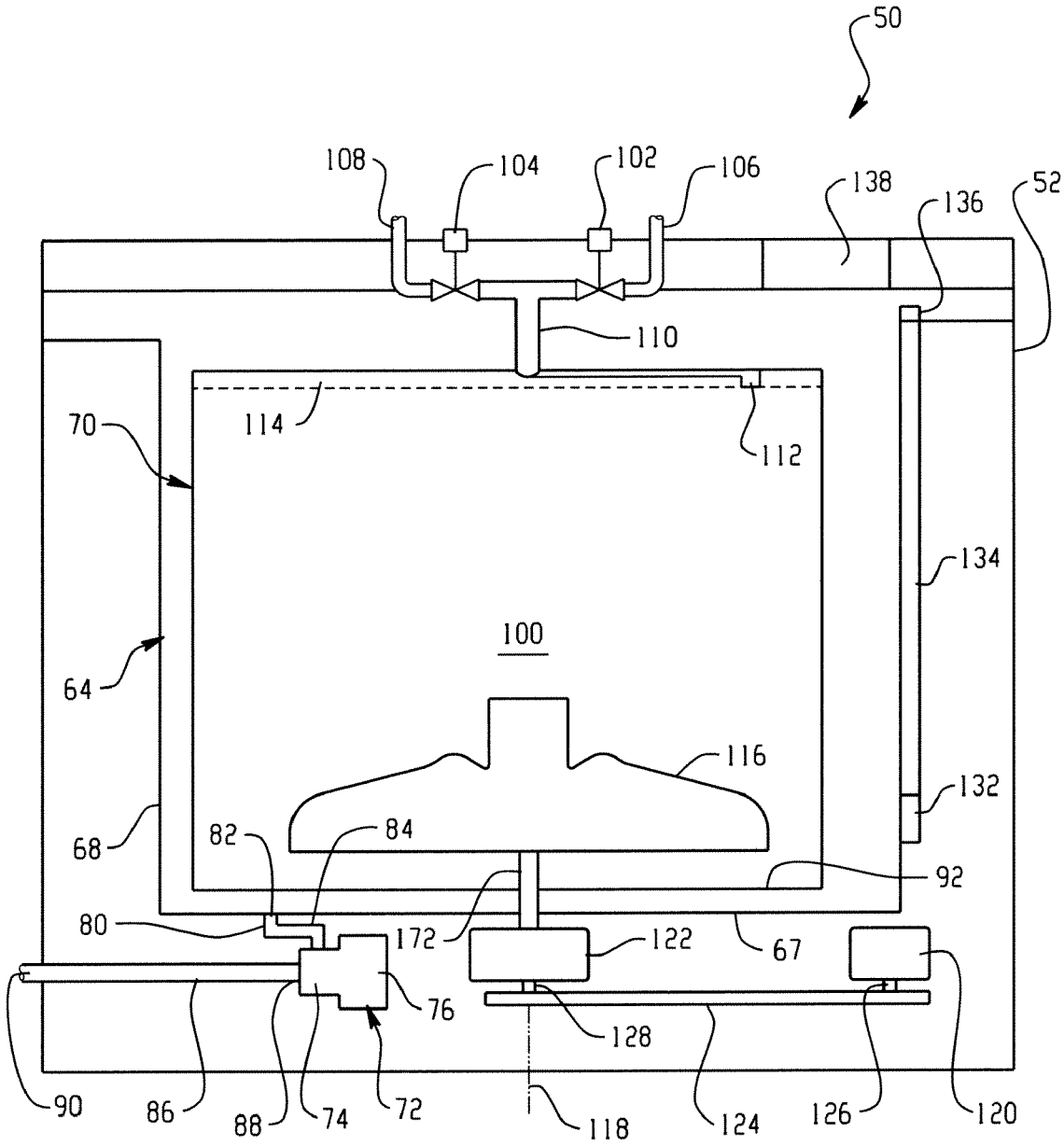
FIG. 2 is an elevational schematic view of the washing machine of FIG. 1 shown having a pulsator.

With additional reference to FIG. 2, the wash tub 64 is located or positioned within the cabinet 52, and a wash basket 70 is movably disposed and rotatably mounted within the wash tub 64. As is known and understood by those skilled in the art, the basket 70 can include a plurality of apertures or perforations to facilitate fluid communication between an interior 100 of the basket 70 and the wash tub 64. A pulsator 116 is rotatably positioned within the basket 70 on vertical axis 118 for imparting motion to articles and liquid received within the basket 70.

The wash tub 64 includes a bottom wall 67 and a side wall 68, the basket 70 being rotatably mounted or supported within the tub 64 in spaced apart relation from the tub bottom wall 67 and the side wall 68. A pump assembly 72 is located beneath the wash tub 64 and the basket 70 for gravity assisted flow when draining the tub 64. The pump assembly 72 includes a pump 74, a motor 76, and in an exemplary embodiment a motor fan (not shown). A pump inlet hose 80 extends from a wash tub outlet 82 in tub bottom wall 67 to a pump inlet 84, and a pump outlet hose 86 extends from pump outlet 88 to an appliance washing machine water outlet 90 and ultimately to a building plumbing system discharge line (not shown) in flow communication with the outlet 90.

A hot liquid valve 102 and a cold liquid valve 104 deliver fluid, such as water, to the basket 70 and the wash tub 64 through a respective hot liquid hose 106 and a cold liquid hose 108. Liquid valves 102,104 and liquid hoses 106,108 together form a liquid supply connection for the washing machine 50 and, when connected to a building plumbing system (not shown), provide a water supply for use in the washing machine 10. Liquid valves 102,104 and liquid hoses 106,108 are connected to a basket inlet tube 110, and fluid is dispersed from the inlet tube 110 through a nozzle assembly 112 having a number of openings therein to direct washing liquid into basket 70 at a given trajectory and velocity. A known dispenser (not shown in FIG. 2) may also be provided to produce a wash solution by mixing fresh water with a known detergent or other composition for cleansing of articles in the basket 70.

In an alternate embodiment, a spray fill conduit 114 (shown in phantom in FIG. 2) can be employed in lieu of the nozzle assembly 112. Along the length of the spray fill conduit 114 can be a plurality of openings arranged in a predetermined pattern to direct incoming streams of water in a downward tangential manner towards articles in the basket 70. The openings in the conduit 114 can be located a predetermined distance apart from one another to produce an overlapping coverage of liquid streams into the basket 70. Articles in the basket 70 may therefore be uniformly wetted even when the basket is maintained in a stationary position.

In an exemplary embodiment, the basket 70 and the pulsator 116 are driven by a motor 120 through a transmission and clutch system 122. A transmission belt 124 is coupled to respective pulleys of a motor output shaft 126 and a transmission input shaft 128. Thus, as motor output shaft 126 is rotated, transmission input shaft 128 is also rotated. Clutch system 122 facilitates driving engagement of the basket 70 and the pulsator 116 (e.g., through shaft 172) for rotatable movement within the wash tub 64, and clutch system 122 facilitates relative rotation of the basket 70 and the pulsator 116 for selected portions of wash cycles. Motor 120, transmission and clutch assembly 122 and belt 124 can collectively be referred to as a machine drive system, the drive system for rotating the basket 70 and/or the pulsator 116. As shown, the pulsator 116 is disposed adjacent bottom 92 of the wash basket 70 and drivingly connected to the illustrated drive system. As will be appreciated by those of skill in the art, the drive system 120,122,124 of the illustrated embodiment can be replaced by any other suitable drive system.

The washing machine 50 can also include a brake assembly (not shown) selectively applied or released for respectively maintaining the basket 70 in a stationary position within the tub 64 or for allowing the basket 70 to spin within the tub 64. Pump assembly 72 is selectively activated to remove liquid from the basket 70 and the tub 64 through drain outlet 90 during appropriate points in washing cycles as machine 50 is used. In an exemplary embodiment, as illustrated, the washing machine also includes a reservoir 132, a tube 134 and a pressure sensor 136. As fluid levels rise in the wash tub 70, air is trapped in the reservoir 132 creating a pressure in the tube 134 that pressure sensor 136 monitors. Liquid levels, and more specifically changes in liquid levels in the wash tub 70, may therefore be sensed, for example, to indicate laundry loads and to facilitate associated control decisions. In further alternative embodiments, load size and cycle effectiveness can be determined or evaluated using other known indicia, such as motor spin, torque, load weight, motor current, voltage, current phase shifts, etc. It is to be understood and appreciated by those skilled in the art, that the reservoir 132, tube 134 and pressure sensor 136 need not be employed in the washing machine 50 of the subject disclosure. In particular, it may be advantageous to simplify the washing machine 50 so as to reduce manufacturing costs and the ultimate end cost to a consumer by eliminating the reservoir 132, tube 134 and pressure sensor 136.

Operation of the machine 50 can be controlled by a controller 138, though this is not required (for example, simple electromechanical controls can be employed for controlling and operating the washing machine 50). The controller 138 can be operatively connected to the user interface input located on the washing machine backsplash 58 for user manipulation to select washing machine cycles and features. In response to user manipulation of the user interface input, the controller 138 operates the various components of the machine 50 to execute selective machine cycles and features. The controller 138 is operatively coupled to the drive system 120,122,124 and the nozzle assembly 112 (or alternatively the spray conduit 114).

Figure 3:
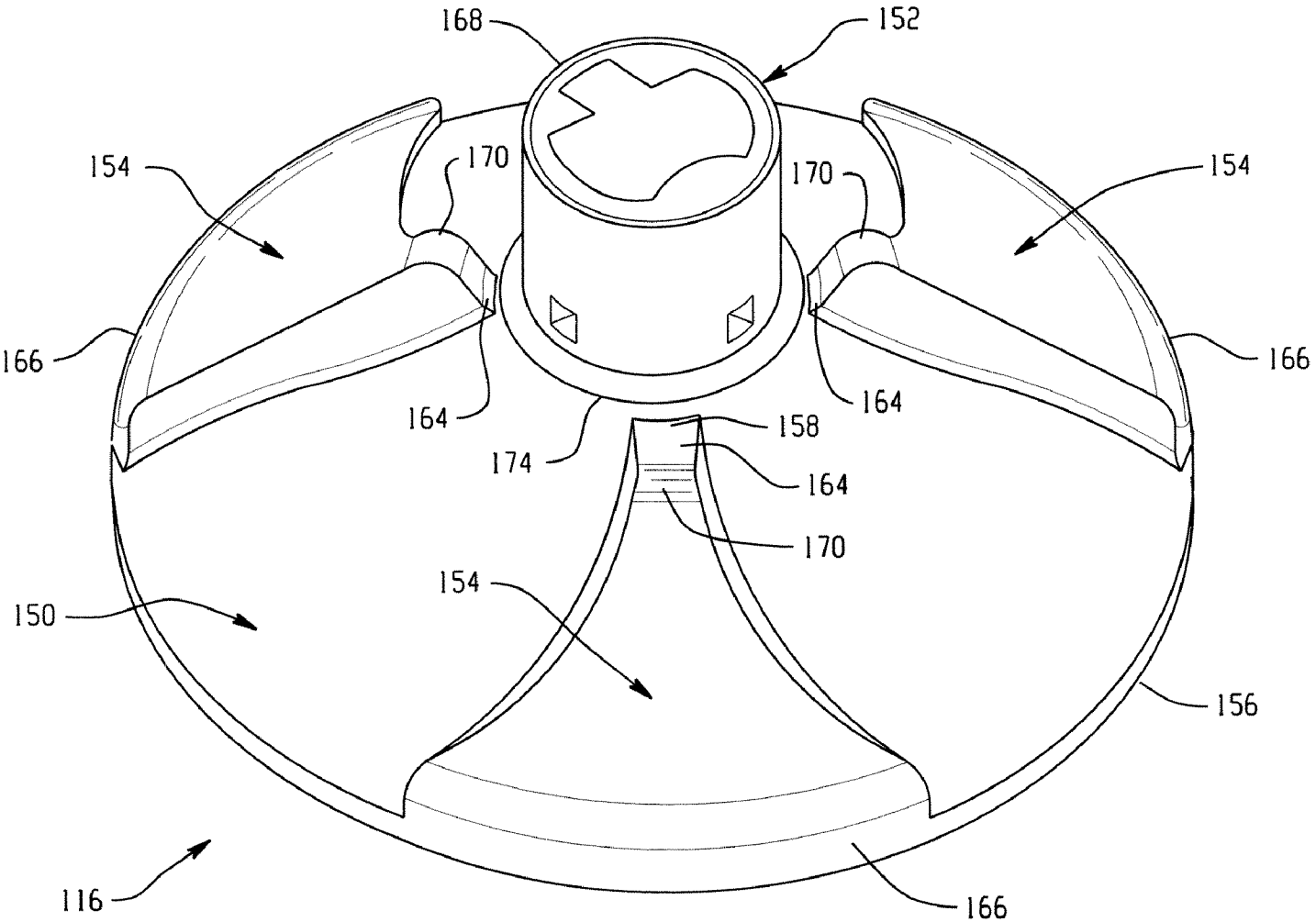
FIG. 3 is a perspective view of the pulsator having a plurality of radially extending vanes.
Figure 4:
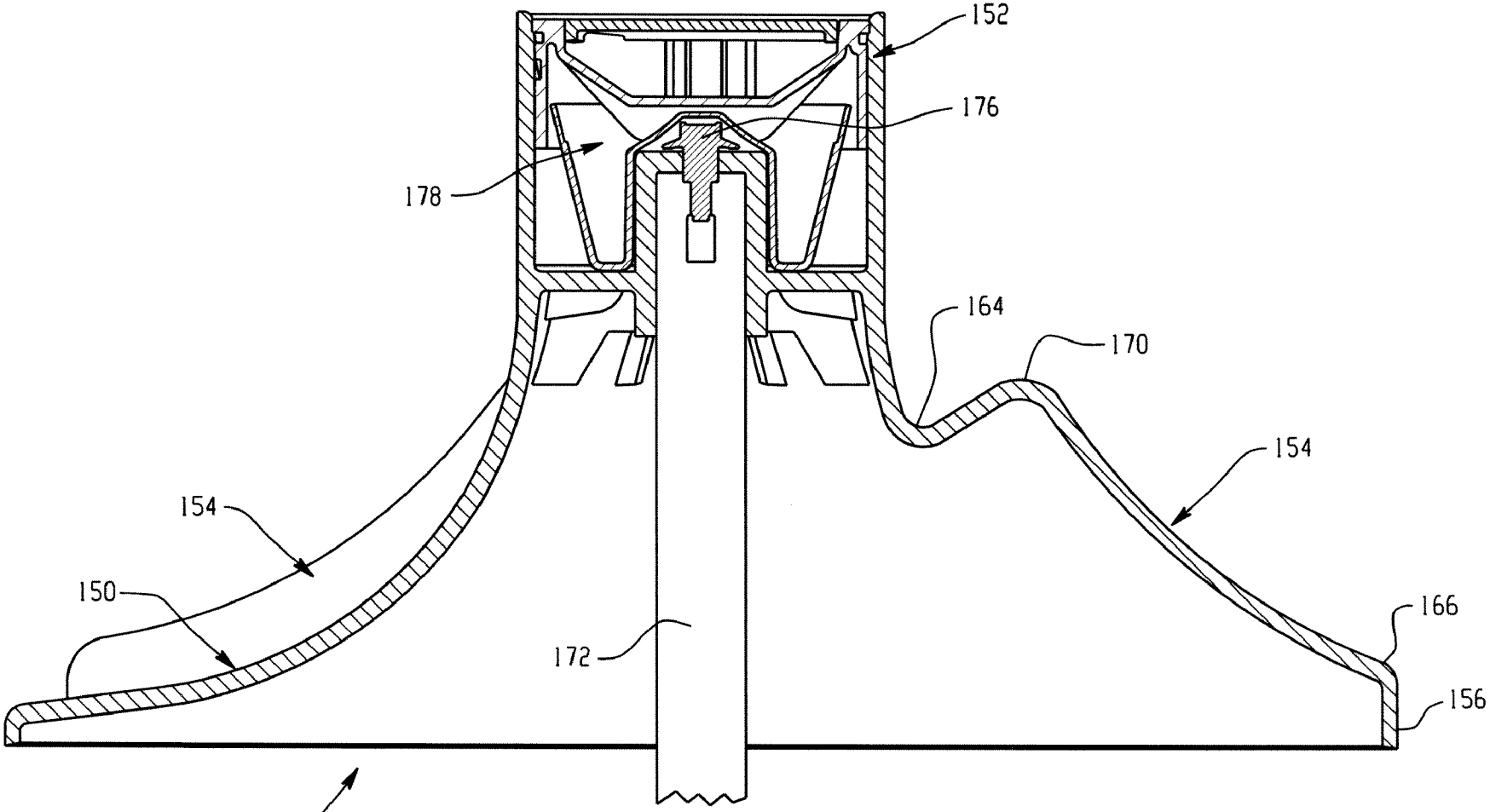
FIG. 4 is a cross-sectional view of the pulsator mounted to a shaft of the washing machine, the cross-sectional view taken through one of the radially extending vanes.
Figure 5:
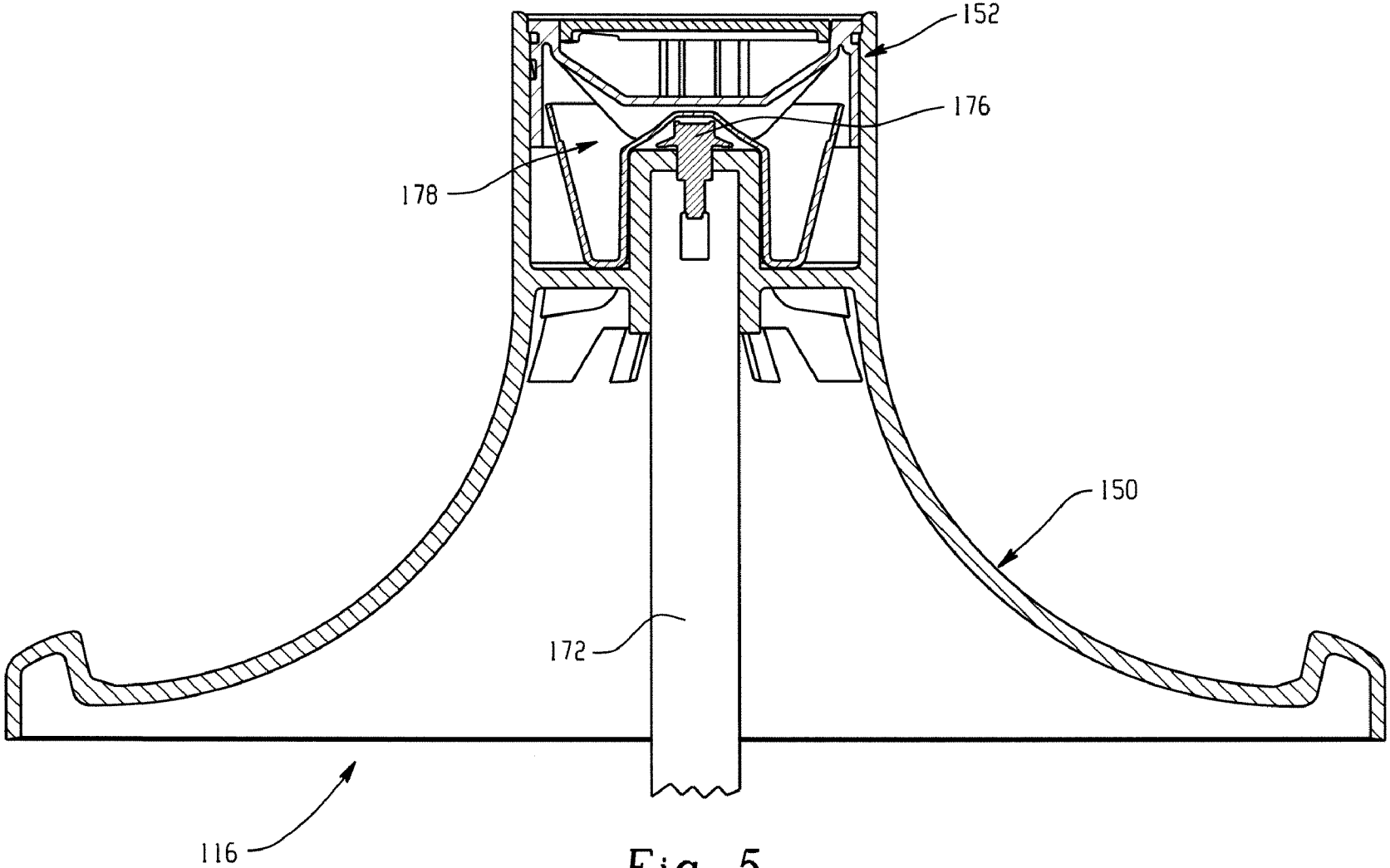
FIG. 5 is another cross-sectional view of the pulsator mounted to the shaft, but taken between the radially extending vanes.

With reference now to FIGS. 3-5, the pulsator 116 includes a base portion 150, a central hub 152 extending upward from the base portion 150, and a plurality of radially extending vanes 154 (three in the illustrated embodiment, though other numbers of vanes could be employed) extending upward from the base portion 150. As shown, each of the vanes 154 extends radially from about a peripheral radial edge 156 of the base portion 150 to a location (e.g., location 158) radially spaced apart from the central hub 152. The pulsator 116, which has a bell-shape, can be mounted within the washing machine 50 such that the base portion 150 is disposed closely adjacent the bottom 92 of the rotatably supported wash basket 70, which further reduces the profile, particularly the height element thereof, of the pulsator 116. In the illustrated embodiment, the central hub 152 of the pulsator 116 is mounted to shaft 172 by a suitable fastener, such as bolt 176.

Each of the plurality of radially extending vanes 154 includes an inward radial portion or end 164 disposed at the location, such as location 158, that is radially spaced apart from the central hub 152, and also includes an outer radial portion or end 166. In addition to being radially spaced apart from the central hub 152, the inward radial end 164 of each of the vanes 154 is also axially spaced apart relative to an upper lip 168 of the central hub 152. Each of the vanes 154 includes an apex portion 170 positioned radially between the inward radial end 164 and the outward radial end 166. As shown, the apex portion 170 is spaced an axial distance relative to the upper lip 168 of the central hub 152 a lesser amount than each of the inward and outer radial ends 164,166, and the inward radial end 164 of each vane 154 is also spaced an axial distance relative to the upper lip 168 a lesser amount than the outward radial end 166. In addition, the apex portion 170 of each of the vanes 154 is spaced apart from the base portion 150 of the pulsator 116 a greater distance than each of the inward and outward radial ends 164,166. More particularly, each of the inward and outward radial ends 164,166 blends into the base portion 150, whereas the apex portion 170 remains spaced apart from the base portion 150. Also, the inward radial end 164 of each of the vanes 154 is adjacent a base 174 of the central hub 152 and is axially spaced between the outward radial end 166 and the distal end 168 of the hub.

As best shown in FIG. 4, the specific contour of each of the vanes 154 is such that each vane slopes upwardly (axially) from the inward radial end 164 toward the apex portion 170 and then slopes downwardly (axially) from the apex portion 170 toward the outward radial edge 156, and particularly to the outward radial end 166. In the illustrated embodiment, as shown, the outward radial end 166 of each of the vanes 154 is located at (or adjacent) the peripheral radial edge 156 of the base portion 150. This shape or contour provides the advantage that less noise is created during washings than in pulsator designs where the vanes or fins start at the central hub (i.e., are not spaced apart radially from the central hub). In addition to being quieter, the shape or contour of the fins 154 entrains less air in the wash water thereby creating less suds. This enables the washing machine 50 to use standard detergent types, rather than being limited to less readily available HE (High Efficiency) detergent types thereby providing a substantial commercial advantage.

The pulsator 116 of the illustrated embodiment is apertureless. In other words, the pulsator 116 has no apertures and, as best shown in FIGS. 3 and 4, is sealed to mating input shaft 172, which extends from the transmission and clutch assembly 122 (see FIG. 2). The pulsator 116 being apertureless, and particularly the base portion 150 and vanes 154 thereof being apertureless, prevents water from rising underneath the pulsator 116. As a result of the pulsator 116 being apertureless and/or as a result of the pulsator 116 being sealed to the input shaft 172 of the drive system 120,122,124, water is substantially prevented from rising underneath the pulsator 116. This advantageously increases the height of water in the basket 70 for a given amount of water used in a particular wash cycle thereby reducing the total amount of water required by the washing machine 50 for any given wash cycle. In addition, this arrangement also advantageously prevents or at least substantially reduces the likelihood of laundry articles being sucked under the pulsator 116 thereby improving the performance of the washing machine 50 and reducing the opportunity for damage to laundry articles washed thereby.

The pulsator 116 of the illustrated embodiment has been found to provide very good wash action over a wide range of water levels used within the washing machine. Specifically, the vanes 154 and or the bell-shape of the pulsator 116, particularly the bell-shape body or base portion 150 thereof allows the operation of the pulsator 116 to be largely insensitive to water level. In contrast, other pulsator-type wash systems are typically very sensitive to the water level used and must therefore use complex or costly adaptive fill algorithms or hardware to function acceptably. The pulsator 116 could allow the consumer to select the water level with a conventional low-cost electromechanical pressure switch on a machine so equipped and does not require the use of an adaptive fill or other electronic systems. More specifically, use of the pulsator 116 allows the control system 138, if desirable, to be used without any sensors (e.g., water level sensors), though one is depicted in the illustrated embodiment. When no sensors are used in conjunction with the control system 138, it can be referred to as a sensorless control system. In any case, when employed, the controller 138 is operatively coupled to the drive system 120,122,124 and functions to control the supply of water to the wash tub 64, and driving of the pulsator 116 by the drive system 120,122, 124. As is known, the pulsator 116 can be driven by the controller 138 such that a clothes load received in the wash basket 70 can have a rollover action imparted thereto.

The pulsator 116 of the illustrated embodiment also advantageously enables the use of a centrifugal-type fabric softener dispenser, such as dispenser 178, though this is not required. When included, the fabric softener dispenser 178 can be a submergible-type, such as disclosed in the above-referenced U.S. patent application entitled "Fabric Softener Dispenser For Pulsator Wash System," that is mounted to the pulsator 116 or contained within it, or alternatively formed integrally with the hub 152, as shown in the illustrated embodiment, for example. More particularly, the overall shape of the pulsator 116, which as already discussed is substantially bell-shaped rather than conventional flatter designs, moves laundry items received in the basket 70 in such a way that the presence of the centrifugal-type fabric softener dispenser 178 mounted in the hub 152 of the pulsator 116 does not impede turnover or rollover action. In particular, the pulsator 116 positions the dispenser 178 at a height that is convenient for the consumer (i.e., not too low), but down low enough to maintain a low profile for the pulsator 116 and thereby prevent entanglement with laundry items in the wash basket 170. Alternatively, the pulsator 116 could be formed without the dispenser 178 or could include some other type of dispenser.

As a result of the pulsator 116 of the illustrated embodiment being largely insensitive to water levels, the pulsator wash system or machine 50 can be a large capacity-type machine, such as greater than 3.1 cubic feet (DOE) for example, and/or can be a vertical axis washer that uses an electromechanical control system. In contrast, typical conventional large capacity vertical axis washers with pulsator wash systems require electronic controls. Advantageously, the washing machine 50 of the illustrated embodiment can be used in a substantially less costly and less complex electromechanical-controlled large vertical axis washing machine.

The exemplary embodiment or embodiments have been described with reference to preferred embodiments. Obviously, modifications and alterations will occur to others upon reading and understanding the preceding detailed description. It is intended that the exemplary embodiments be construed as including all such modifications and alterations insofar as they come within the scope of the appended claims or the equivalents thereof.

What is claimed is:

1. A pulsator wash system, comprising:

a cabinet;

a wash tub supported within said cabinet;

a wash basket supported within said wash tub having a bottom and open top dimensioned to receive a wash load therein;

a drive system for rotating said wash basket; and a pulsator disposed adjacent the bottom of said wash basket and extending upwardly less than one-half of a dimension between the bottom and open top of the wash basket, and drivingly connected to said drive system, said pulsator including a base portion, a central hub extending upward from said base portion, and a plurality of radially extending vanes extending upward from said base portion, each of said plurality of radially extending vanes extending radially from about a peripheral radial edge of said base portion to a location radially spaced apart from said central hub, and each vane having a generally delta-shape that has a greater dimension adjacent the peripheral radial edge and a lesser dimension closer to the central hub.

2. The pulsator wash system of claim 1 wherein each of said plurality of radially extending vanes includes an inward radial end and an outward radial end, said inward radial end radially spaced apart from said central hub and axially spaced apart relative to a distal end of said central hub.

3. The pulsator wash system of claim 2 wherein each of said plurality of radially extending vanes includes an apex portion radially between said inward radial end and said outward radial end.

4. The pulsator wash system of claim 3 wherein said apex portion is spaced an axial distance relative to said distal end of said central hub a lesser amount than each of said inward and outward radial ends.

5. The pulsator wash system of claim 3 wherein said apex portion is spaced apart from said base portion a greater distance than each of said inward and outward radial ends.

6. The pulsator wash system of claim 3 wherein each of said plurality of radially extending vanes slopes upwardly from said inward radial end toward said apex portion and slopes downwardly from said apex portion toward said outward radial edge.

7. The pulsator wash system of claim 2 wherein said outward radial end is located at said peripheral radial edge of said base portion.

8. The pulsator wash system of claim 1 wherein said base portion of said pulsator is apertureless to prevent water from rising from underneath said pulsator.

9. The pulsator wash system of claim 8 wherein said pulsator is sealed to an input shaft of said drive system.

10. The pulsator wash system of claim 8 wherein said pulsator is apertureless.

11. The pulsator wash system of claim 1 wherein said hub and said base portion form a bell-shape.

12. The pulsator wash system of claim 1 further including a sensorless control system including a controller operatively coupled to said drive system, said controller controlling supply of water to said wash tub, and driving of said pulsator by said drive system, said pulsator driven such that a cloths load received in said wash basket have a rollover action imparted thereto.

13. A pulsator for a washing machine, comprising:

a base portion;

a central hub extending upward from said base portion; and a plurality of radially extending vanes extending upward from said base portion, each of said plurality of radially extending vanes extending radially from a peripheral radial edge of said base portion to a location radially spaced apart from said central hub, and each of said plurality of radially extending vanes having a generally delta-shape with a first, greater circumferential dimension adjacent the peripheral radial edge of the base portion, and a second, reduced circumferential dimension closer to the central hub that is less than the first dimension.

14. The pulsator of claim 13 wherein each of said plurality of radially extending vanes includes an inward radial end, an outward radial end at said peripheral radial edge, and an apex portion radially disposed between said inward radial end and said outward radial end, wherein said inward radial end is radially spaced apart from said central hub and axially spaced apart relative to a distal end of said central hub.

15. The pulsator of claim 14 wherein said apex portion is axially spaced from said distal end of said central hub.

16. The pulsator of claim 13 wherein each of said plurality of radially extending vanes slopes upwardly from said inward radial end toward said apex portion and slopes downward from said apex portion toward said outward radial edge.

17. The pulsator of claim 16 wherein said inward radial end is adjacent a base of said central hub and is axially spaced between said outward radial end and said distal end of said central hub.

18. The pulsator of claim 13 wherein said base portion and said plurality of radially extending vanes are apertureless.

19. A pulsator for a washing machine, comprising:

a base portion disposed adjacent a bottom of a rotatably supported wash basket of the washing machine;

a central hub extending upward from said base portion; and a plurality of radially extending vanes extending upward from said base portion, each of said plurality of radially extending vanes sloping upwardly from a peripheral radial edge of said base portion to an apex portion and then sloping downwardly to a location radially spaced apart from said central hub, and having a first, greater circumferential dimension adjacent the peripheral radial edge, and a second, reduced circumferential dimension closer to the central hub that is less than the first dimension, wherein said base portion and said plurality of radially extending vanes are apertureless.

20. The pulsator of claim 19 wherein each of said plurality of radially extending vanes includes an inward radial end at said location and an outward radial end at said peripheral radial edge, said inward radial end axially spaced apart from said distal end of said central hub.

21. A pulsator wash system, comprising:

a wash tub;

a wash basket supported within the wash tub, the wash basket having a bottom and open top dimensioned to receive a wash load therein;

a drive shaft for rotating the wash basket; and an apertureless pulsator driven by the drive shaft and disposed adjacent the bottom of the wash basket and extending upwardly less than one-half of a dimension between the bottom and open top of the wash basket, and sealed to the drive shaft, the pulsator including a base portion, a central hub extending upward from the base portion, and a plurality of radially extending vanes extending upward from the base portion, each of the plurality of radially extending vanes extending radially from about a peripheral radial edge of the base portion to a location radially spaced from the central hub, each of said plurality of radially extending vanes having a generally delta-shape with a first, greater circumferential dimension adjacent the peripheral radial edge of the base portion, and a second, reduced circumferential dimension closer to the central hub that is less than the first dimension, and each of the vanes having an apex portion radially located between the peripheral radial edge and the location radially spaced from the hub.

22. The pulsator wash system of claim 21 wherein the apex portion is spaced an axial first dimension from a distal end of the central hub that is less than an axial second dimension of each of the radial edge and radially spaced location.

* * * * *